US006965543B1

(12) United States Patent
Shum et al.

(10) Patent No.: US 6,965,543 B1
(45) Date of Patent: Nov. 15, 2005

(54) RADIO CONTROLLABLE CLOCK

(75) Inventors: Wai Ki Shum, Tin Shui Wai (HK); Wan Sang Chan, Tsuen Wan (HK)

(73) Assignee: Kienzle Time (Hong Kong) Limited, Kowloon (HK)

( * ) Notice: Subject to any disclaimer, the term of this patent is extended or adjusted under 35 U.S.C. 154(b) by 762 days.

(21) Appl. No.: 09/695,571

(22) Filed: Oct. 24, 2000

(51) Int. Cl.[7] ..... G04C 11/02

(52) U.S. Cl. ..... 368/47; 368/238; 368/228; 368/242; 368/84

(58) Field of Search ..... 368/47, 84, 228, 368/238, 242, 76, 52, 51, 239, 112, 80, 89, 73, 204, 223

(56) References Cited

U.S. PATENT DOCUMENTS

| | | | | | |
|---|---|---|---|---|---|
| 3,120,298 | A | * | 2/1964 | Rossi | 368/89 |
| 4,348,752 | A | * | 9/1982 | Perucchi | 368/187 |
| 4,435,046 | A | * | 3/1984 | Nishimura | 368/242 |
| 5,479,379 | A | * | 12/1995 | Tsuchiya et al. | 368/80 |
| 5,825,353 | A | * | 10/1998 | Will | 368/223 |
| 5,886,953 | A | * | 3/1999 | Kawahara et al. | 368/204 |
| 6,351,435 | B1 | * | 2/2002 | Kronenberg et al. | 368/112 |
| RE38,197 | E | * | 7/2003 | Sakamoto et al. | 368/73 |

FOREIGN PATENT DOCUMENTS

| | | |
|---|---|---|
| DE | 12 69 060 | 6/1963 |
| EP | 0 651 301 | 8/1994 |
| EP | 0 720 073 | 12/1995 |
| FR | 1495125 | 9/1966 |
| FR | 2 639 727 | 11/1989 |

* cited by examiner

*Primary Examiner*—David Martin
*Assistant Examiner*—Jeanne-Marguerite Goodwin
(74) *Attorney, Agent, or Firm*—Gauthier & Connors LLP

(57) ABSTRACT

A radio controllable clock includes an analog display having a plurality of clock hands each fastened to a uniquely associated one of a plurality of clock hand shafts that each rotate about a common axis. The clock also includes a plurality of rotary gears each uniquely associated with one of the clock hand shafts, for rotating the clock hand shafts. Each rotary gear has a face perpendicular to the common axis, wherein each of the rotary gears includes a protrusion extending substantially perpendicular from the face. A microcontroller provides a plurality of drive command signals and the rotary gears are driven responsive to the drive command signals. A reset claw is operably positioned to engage at least one of the protrusions to stop the rotation of the clock hand shaft associated with the protrusion in order to position the clock hand associated with the protrusion at a datum position.

19 Claims, 9 Drawing Sheets

RADIO CONTROLLABLE CLOCK

BACKGROUND OF THE INVENTION

The present invention relates to clocks, and in particular to a radio controllable clock.

Radio controlled clocks are capable of automatically adjusting the time after successfully receiving a radio time signal and decoding the signal to drive the hand shafts of an associated analog clock to an exact time position. To accurately set the time of the analog clock, the second hand shaft, minute hand shaft, hour hand shaft and optionally the alarm hand shaft each have to start at a datum/reference position whenever the system is reset, so the microcontroller knows the starting position and can calculate how many pulses must be generated to rotate each shaft to the desired position.

Conventional reset mechanisms are relatively complicated, especially in cases where photoelectric barriers are used and the respective rays have to pass through holes provided in respective gears of the hand shafts. In addition, photoelectric barriers are susceptible to malfunctions and in the event of such a malfunction, it is impossible to reset the radio controlled clock.

Therefore, there is a need for a radio controllable clock that facilitates reliablely setting the time displayed by an analog clock.

SUMMARY OF THE INVENTION

According to an aspect of the present invention, a radio controllable clock includes a mechanism that mechanically stops the rotation of clock hands at a predetermined rotational location after rotations initiated by a microcontroller.

Each clock hand is drivenly connected to an associated hand shaft of the clock (e.g., a second hand, a minute hand, and an hour hand), which is preferably driven by separate stepper motors that receive stepper motor command pulse signals from the microcontroller. To stop the rotations of the hand shafts, each shaft includes an associated drive wheel that includes a protrusion, which engages an associated reset claw when the shaft has been rotated into a predefined datum position (e.g., the clock hand is at the 12:00 o'clock position). The system may also include an alarm hand shaft rotatable by yet another stepper motor to reset the alarm hand to the datum position.

The microcontroller may sequentially command the stepper motors to rotate their respective hand shafts to the datum position in preparation for resetting the time displayed by the radio controllable clock. For example, the microcontroller may command the first stepper motor associated with the second hand shaft until it rotates into the desired position, followed by commands to the second stepper motor to rotate the minute hand shaft until it rotates into the desired position, followed by stepper motor commands causing the hour hand shaft to rotate to the desired position. It is possible that a fourth stepper motor rotates the alarm hand shaft into the desired position.

To reliably ensure a precise reset of the respective hands to the datum position, the microcontroller may generate pulses for one and a quarter rotations so that the second hand shaft driven by a second wheel and an axis rotor makes a respectively required rotation, whereas said second wheel is stoppable by the reset claw at the datum (e.g., 12:00 o'clock) position. The same applies to the minute hand shaft driven by a center wheel-shaft, a center wheel-idler, an intermediate wheel, a transmission wheel and a rotor to make a respectively required rotation. In addition, it is possible that the hour hand shaft be driven by a center wheel-shaft, a center wheel-idler, an intermediate wheel, a transmission wheel and a rotor to make a required rotation. The alarm hand shaft may be driven in a similar manner by a center wheel-shaft, a center wheel-idler, an intermediate wheel, a transmission wheel and a rotor to make the required rotation to ensure positioning at the datum location.

The radio controllable clock may include a keypad for manually adjusting time and date, and a display (e.g., LCD or a flat panel display) to present the time and date information.

Upon generation of respective pulses by the microcontroller, the second hand shaft is driven by a second wheel and an achse rotor. The second wheel rotates until it is stopped by the reset claw at the 12:00 o'clock position. The minute hand shaft (e.g., the shaft connected to the minute hand of the clock) is rotatably driven by a center wheel-shaft, a center wheel-idler, an intermediate wheel, a transmission wheel and a rotor. The minute hand shaft rotates until stopped by the reset claw at the datum position. The hour hand shaft and alarm hand shaft are similarly driven to the datum position. When rotations of the four are completed, they are all located at the datum position ready for adjusting upon reception of a radio time signal.

When the system is reset by a switch on the reset knob, the reset claw is activated by the reset knob. The microcontroller halts the system and resets the clock time to 12:00 o'clock, which is presented on the digital display. The microcontroller then generates pulse signals to the stepper motors to rotate the hand shafts respectively. For example, the second hand shaft is rotatably driven by a second wheel and an achse rotor, and rotates until the second wheel is stopped by the reset claw, placing the second hand in the datum position. The minute hand shaft may then be rotatably driven next by the center wheel-shaft, the center wheel-idler, the intermediate wheel, a transmission wheel and a rotor, until the minute hand is located in the datum position. The hour hand shaft and the alarm hand shaft are driven in a similar manner by their drive systems to place their associated hands at the datum position. When rotations of the four are completed, they are all located at the datum position ready for adjusting upon reception of a radio time signal.

The radio controllable clock may be incorporated into a computer (e.g., a personal computer), to ensure that the computers are provided with the exact time regardless of power supply malfunctions and other events/anomalies that may cause the computer clock to deviate from the correct time. In addition, it is possible to remote control the radio controllable clock for ease of operation. In yet another embodiment, the microcontroller may function as a master for the analog clock, which is the slave, thereby obviating the need to receive signals to update the time of the analog clock.

These and other objects, features and advantages of the present invention will become apparent in light of the following detailed description of preferred embodiments thereof, as illustrated in the accompanying drawings.

DETAILED DESCRIPTION OF THE INVENTION

Figure 1:
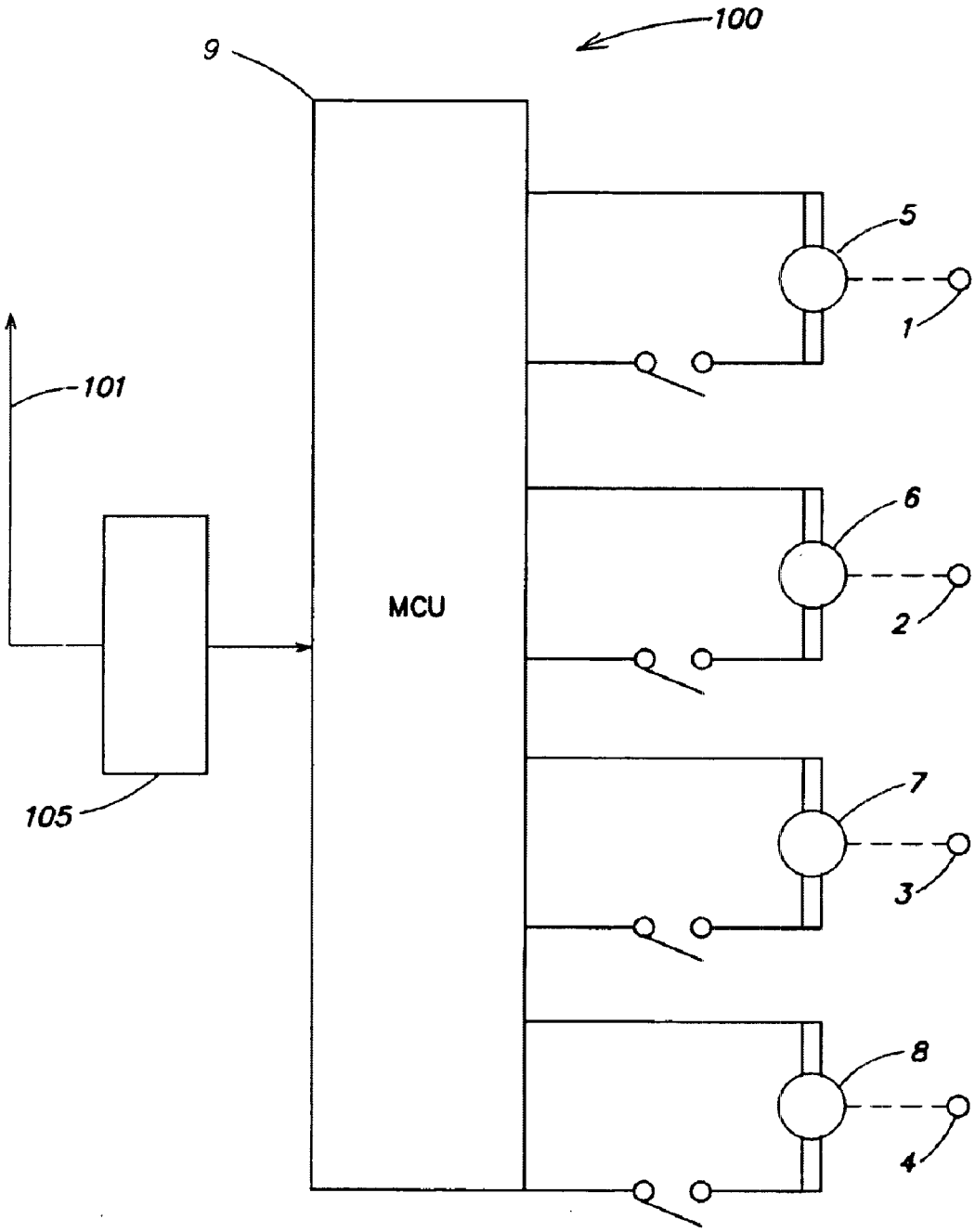
FIG. 1 is a functional block diagram illustration of a radio controllable clock.

FIG. 1 is a functional block diagram illustration of a radio controllable clock 100. The clock 100 includes a microcontroller unit 9 that receives various signals from a radio receiver 105 operably connected to an antenna 101. The microcontroller 9 provides command signals to a plurality of stepper motors 5–8, which are drivenly connected to rotate a second hand shaft 1, a minute hand shaft 2, an hour hand shaft 3, and alarm hand shaft 4, respectively, to control shaft rotation. The shafts 1–4 are connected to drive their respective clock hands.

Figure 2:
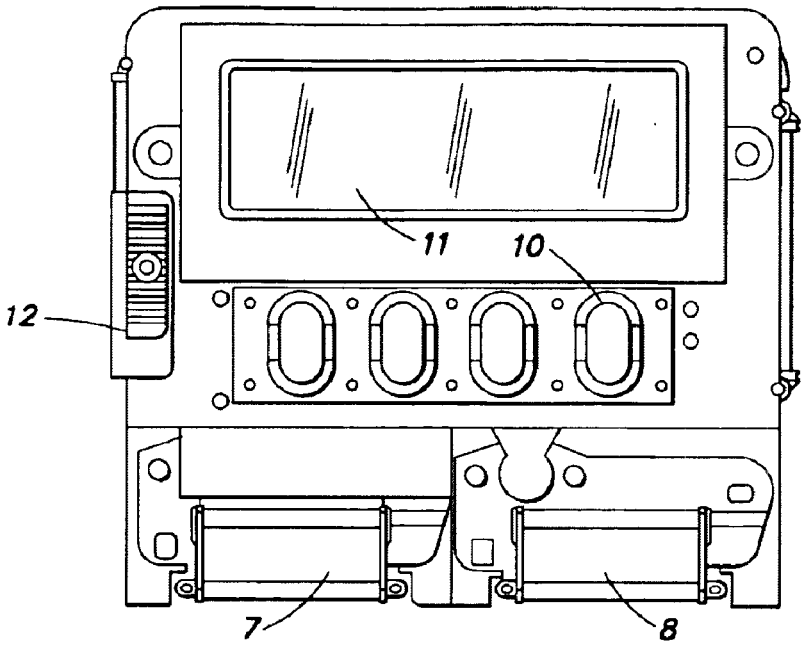
FIG. 2 is a plan view of the radio controllable clock.
Figure 3:
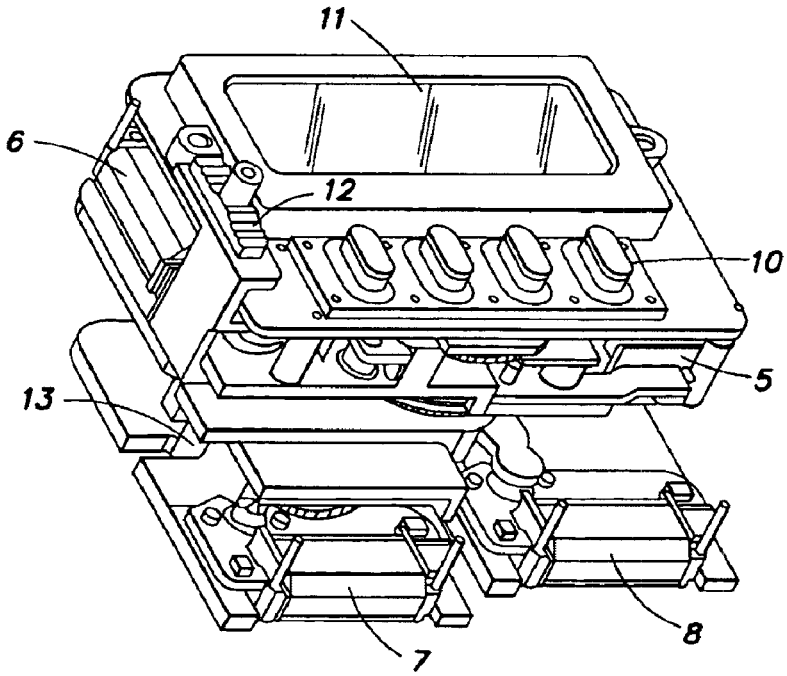
FIG. 3 is an isometric view of the radio controllable clock.

FIG. 2 is plan view illustration of the radio controllable clock, while FIG. 3 is an isometric view of the clock. Referring to FIGS. 1–3, the rotation of second hand shaft 1, minute hand shaft 2, hour hand shaft 3 and optionally an alarm hand shaft 4 are driven by the four independent stepper motors 5, 6, 7 and 8, respectively, which are controlled by digital pulse signals generated by the microcontroller 9 (e.g., a SKC-RDSO I). Manual adjusting of the time and calendar of the clock is performed by digital input via a rubber keypad 10. When time is adjusted manually or after successful reception of a radio time signal, the microcontroller 9 generates pulse signals to the stepper motors 5–8 to drive the second hand shaft 1, the minute hand shaft 2, the hour hand shaft 3 and the alarm hand shaft 4, respectively, to the corresponding position. However, prior to automatically positioning each of the clock hands to the positions encoded in the radio time signal, the microcontroller commands each of the hands to a datum/reference position from which the hands can be rotated to the desired time positions.

Figure 4A:
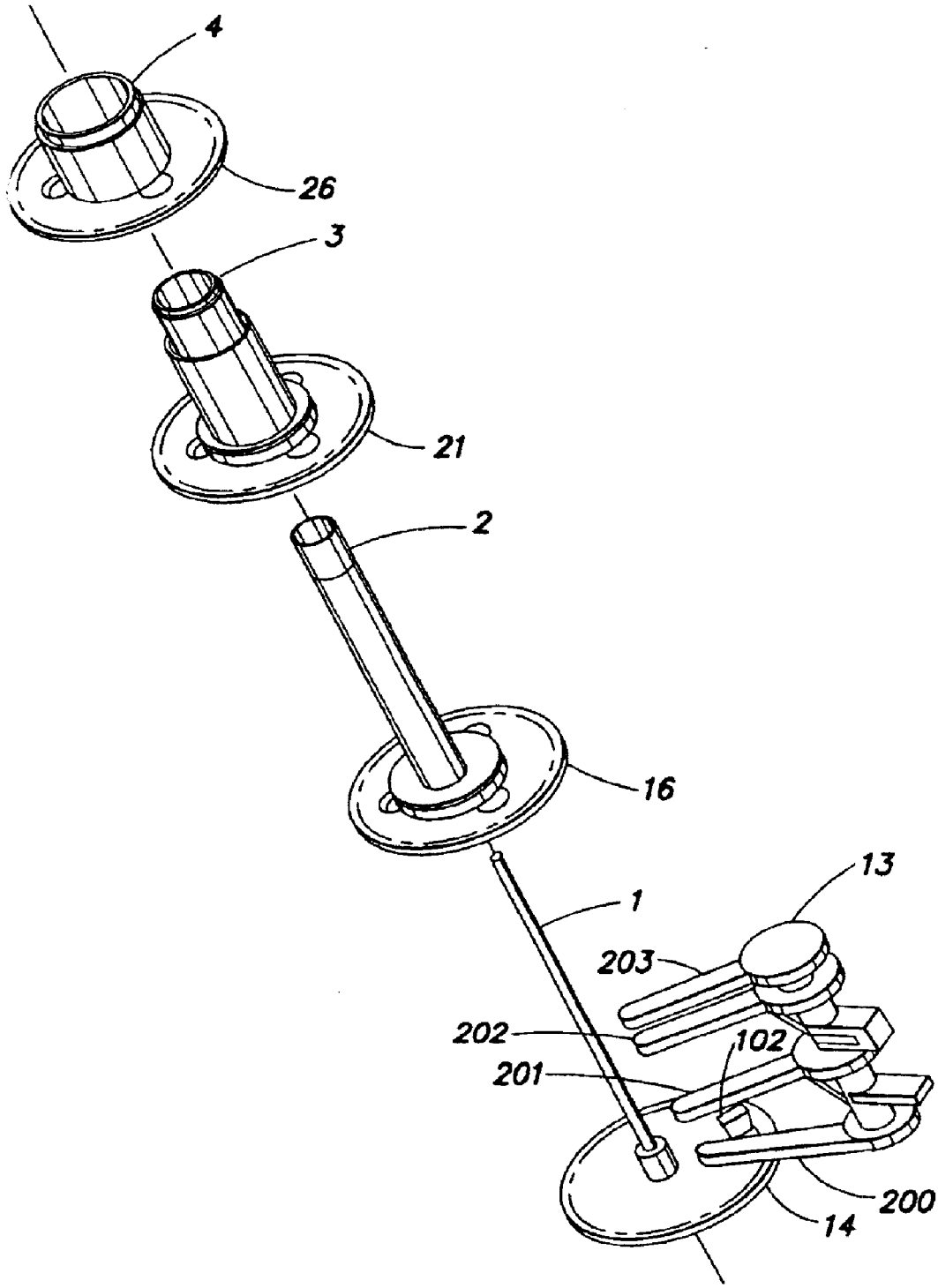
FIG. 4*a* illustrates the concentric hand shafts.
Figure 4B:
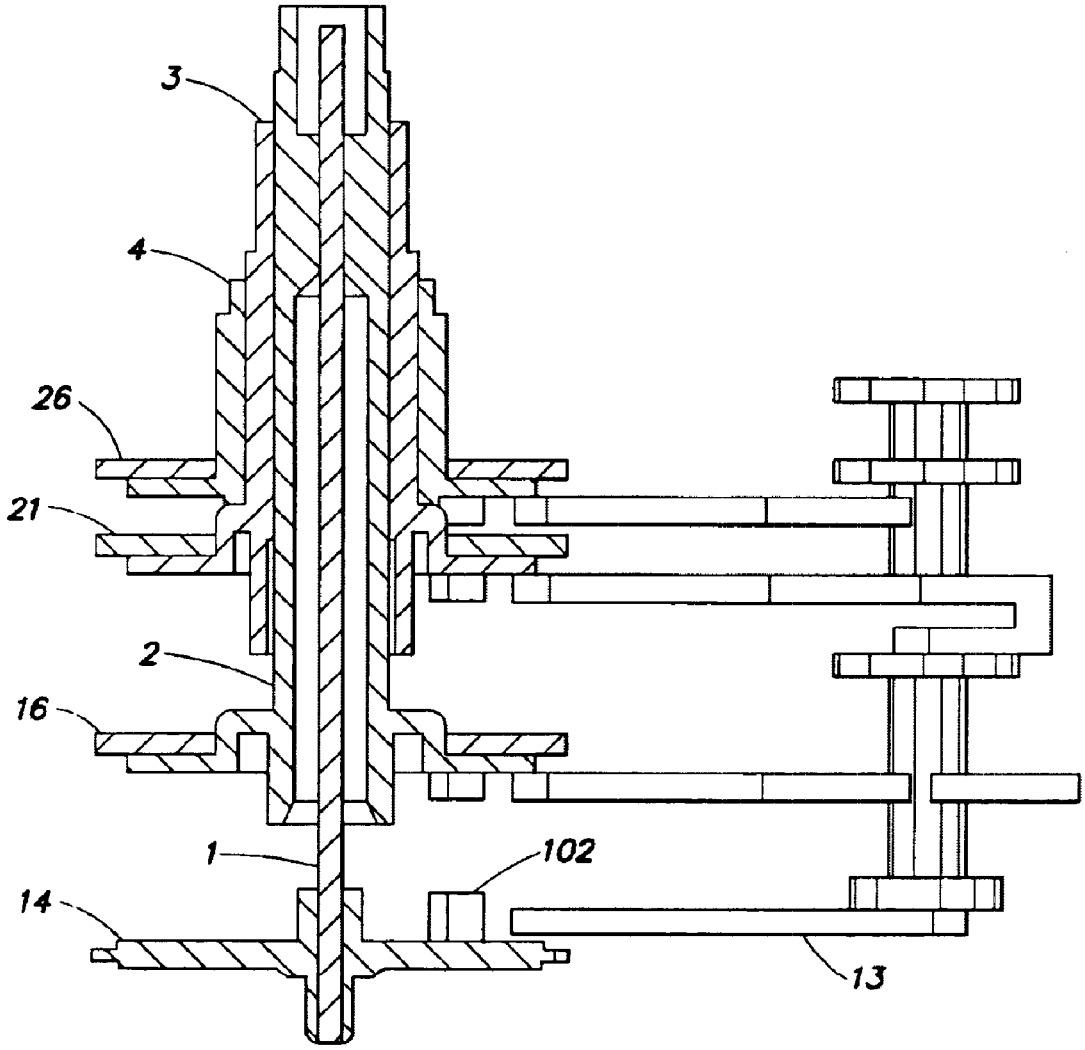
FIG. 4*b* is a cross sectional illustration of the concentric shafts and the reset claw operably positioned.
Figure 5:
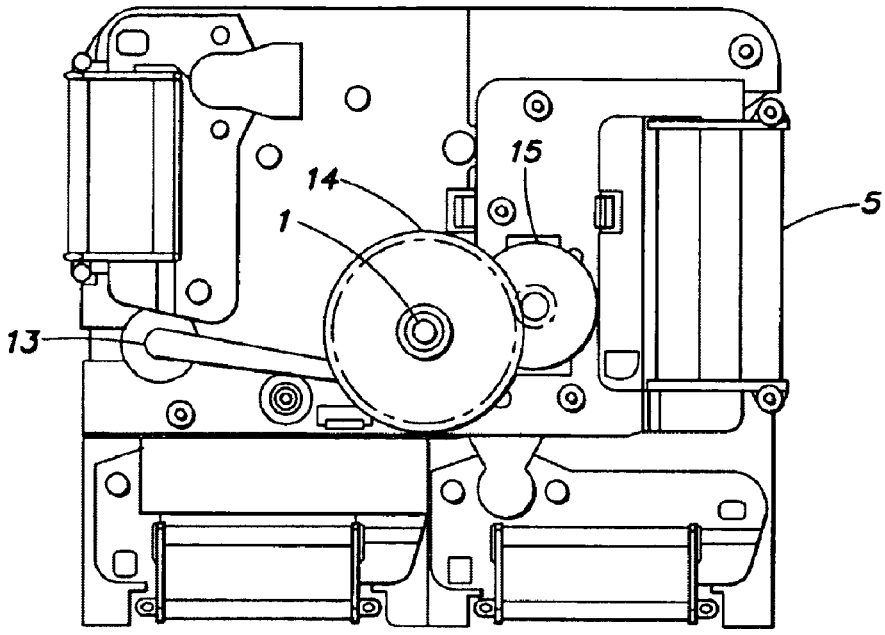
FIG. 5 is a plan view of the second hand shaft and the second hand wheel gear.
Figure 6:
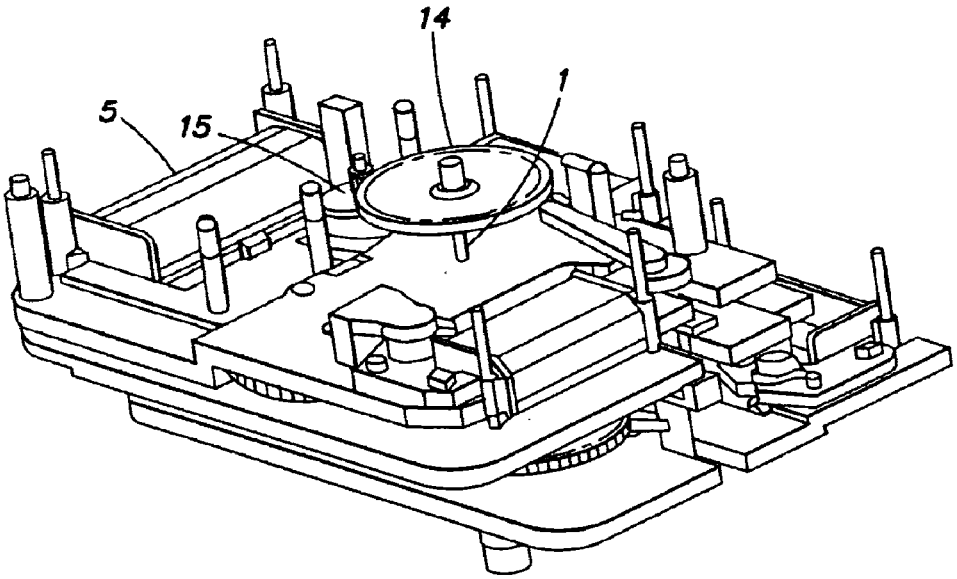
FIG. 6 is an isometric view of the second hand shaft and the second hand wheel gear.

FIG. 4A illustrates the concentric hand shafts 14. Each of the shafts 1–4 includes an associated drive wheel gear 14, 16, 21 and 26 that couples to another gear (not shown in this view) causing the respective hand shaft to rotate. Each of the drive wheel gears also includes a protrusion (e.g., 102) that engages one of the associated arms 200–203 in the reset claw 13 to stop the associated drive wheel from rotating. FIG. 4B is a cross sectional illustration of the concentric shafts and the reset claw operably positioned FIG. 5 is a plan view illustration of the second hand shaft 1 and the second hand wheel gear 14 that drives the second hand shaft 1, while FIG. 6 is an isometric view of the same embodiment. The second hand shaft 1 is rotatably driven by the second wheel 14 and an achse rotor 15. To position the second hand of the clock at the datum position, the microcontroller 9 preferably generates command pulses sufficient for one and a quarter rotation for the second hand. Referring to FIG. 4A, this causes the second hand wheel gear 14 to rotate until the protrusion 102 engages the reset claw 13, stopping the wheel 14 and placing the second hand at the desired datum position. One of ordinary skill in the art will recognize that rather than issuing commands to rotate the second hand one and a quarter rotations, commands for slightly more than one complete rotation are sufficient to ensure that the wheel rotates enough to cause the wheel's protrusion to engage the reset claw, and thus position the associated clock hand at the datum position.

Figure 7:
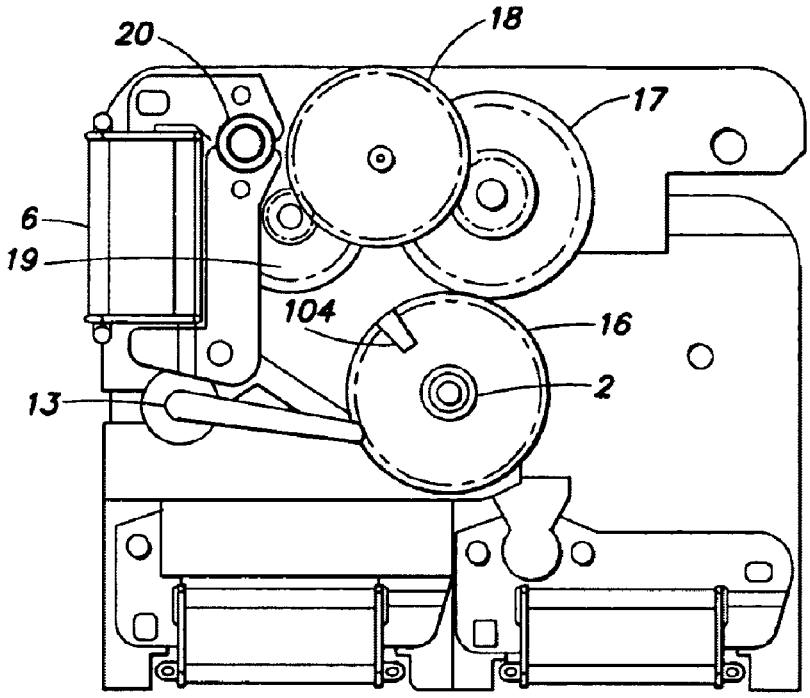
FIG. 7 is a plan view of the minute hand embodiment.
Figure 8:
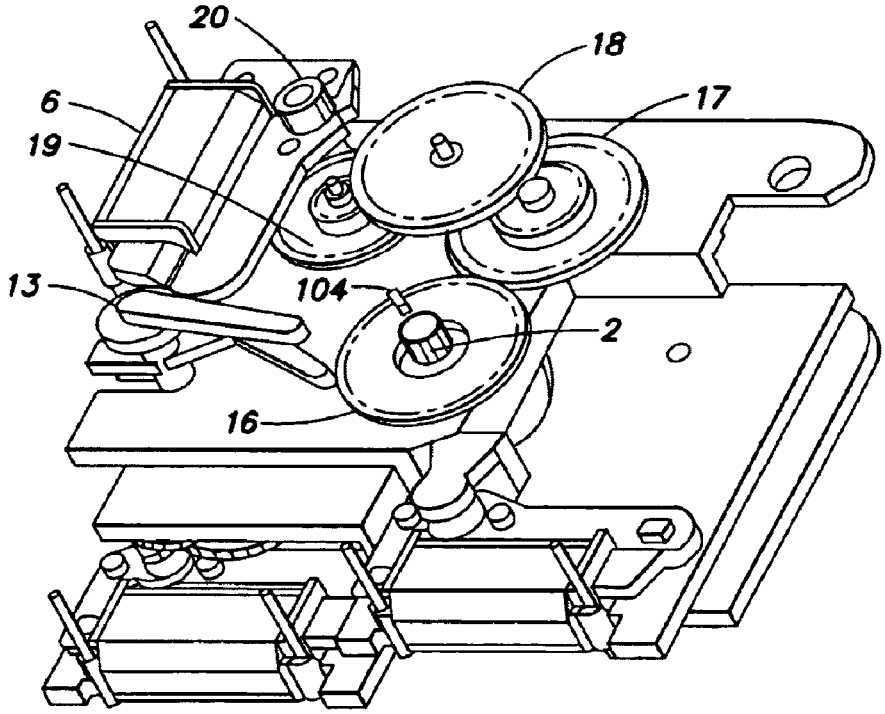
FIG. 8 is an isometric view of the minute hand embodiment.

FIG. 7 is plan view illustration of a minute hand embodiment, while FIG. 8 is an isometric view of the same embodiment. The minute hand shaft 2 is driven by the center wheel-shaft gear 16, a center wheel-idler 17, an intermediate wheel 18, a transmission wheel 19 and a rotor 20 to make the respectively required rotation. The minute hand shaft 2 rotates until its rotation is stopped at the datum position when the reset claw strikes protrusion 104.

Figure 9:
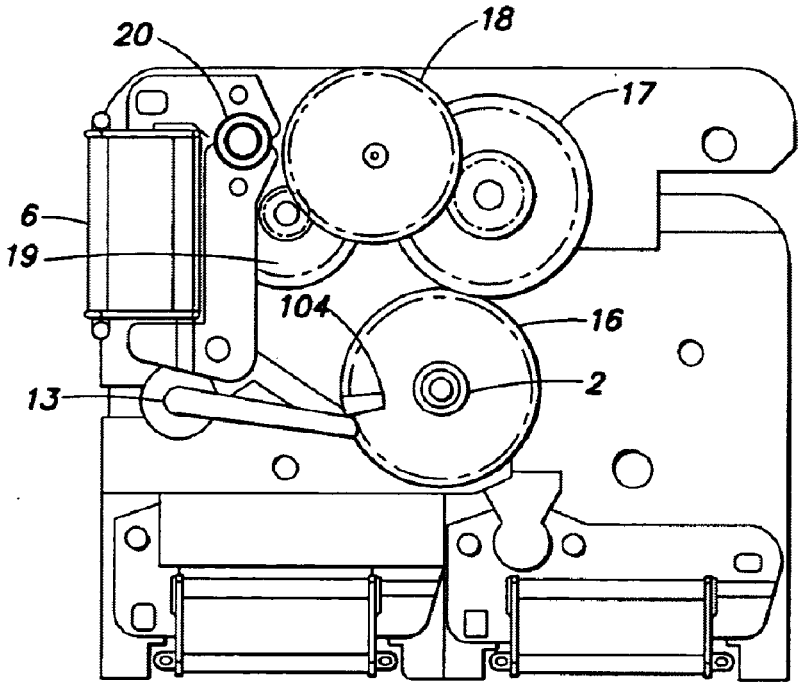
FIGS. 9 and 10 illustrate the position of the minute hand shaft at the datum position.
Figure 10:
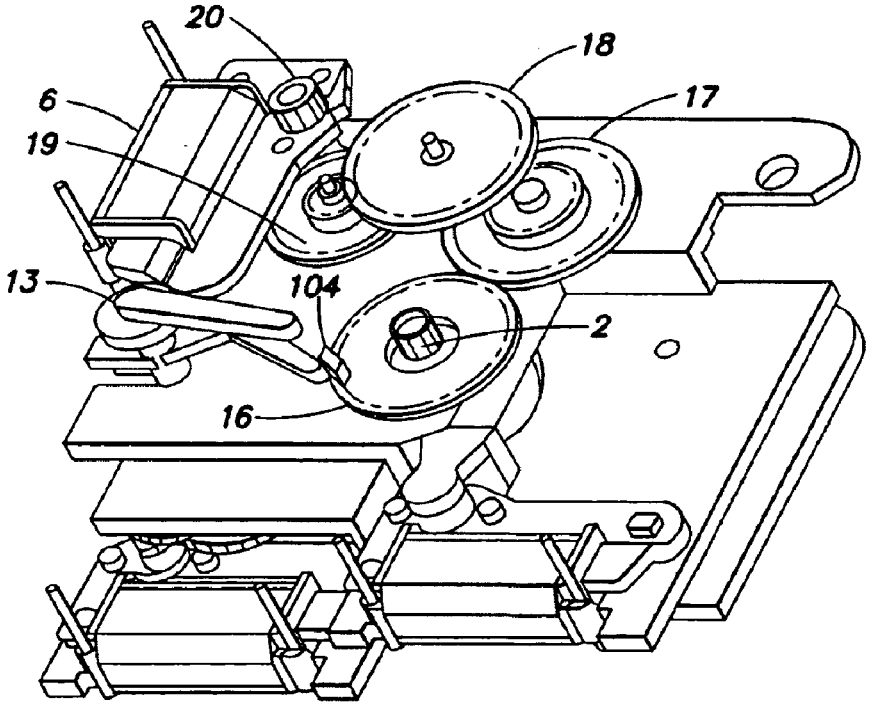

FIGS. 9 and 10 illustrate the minute hand shaft 2 at the datum position. The minute hand shaft 2 is driven by the center wheel-shaft 16, the center wheel-idler 17, the intermediate wheel 18, the transmission wheel 19 and the rotor 20 to make the required positioning rotation. During the rotation, the protrusion 104 strikes the arm of the reset claw 13, stopping the rotation of the minute hand shaft 2 at the datum position.

Figure 11:
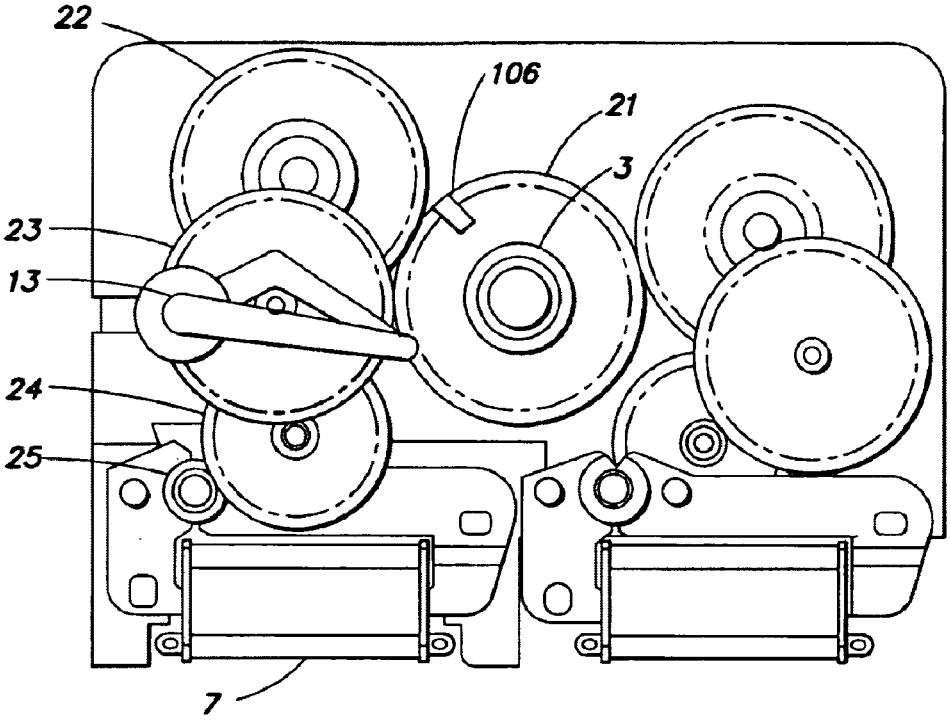
FIG. 11 is a plan view of an hour hand embodiment.
Figure 12:
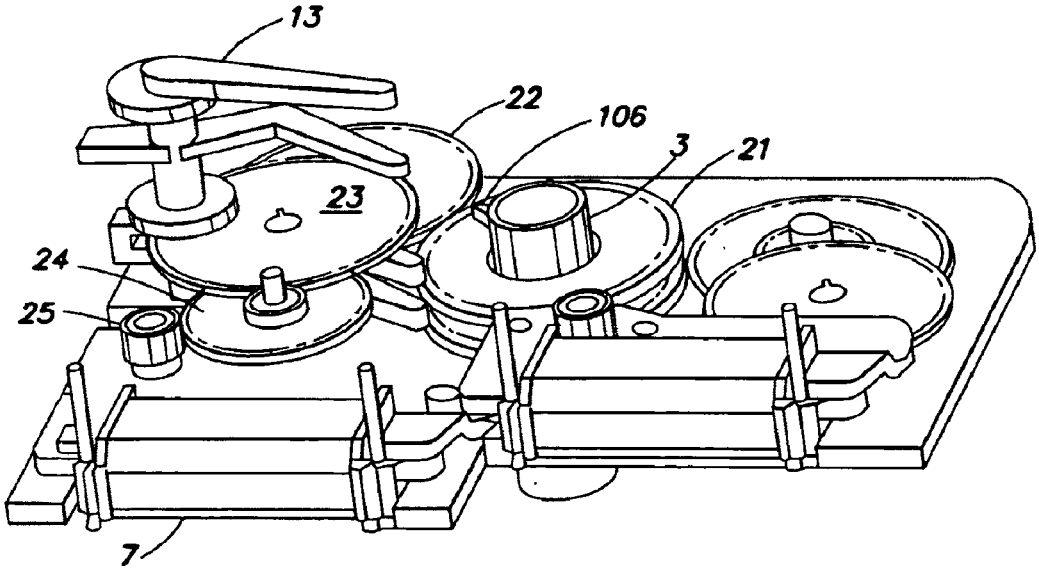
FIG. 12 is an isometric view of an hour hand embodiment.

FIG. 11 is plan view illustration of an hour hand embodiment, while FIG. 12 is an isometric view of the same embodiment. The hour hand shaft 3 is driven by a center wheel-shaft gear 21, a center wheel-idler 22, an intermediate wheel 23, a transmission wheel 24 and a rotor 25 to make the desired positioning rotation. The hour hand shaft 3 rotates until the protrusion 106 strikes the reset claw 13 at the datum position.

Figure 13:
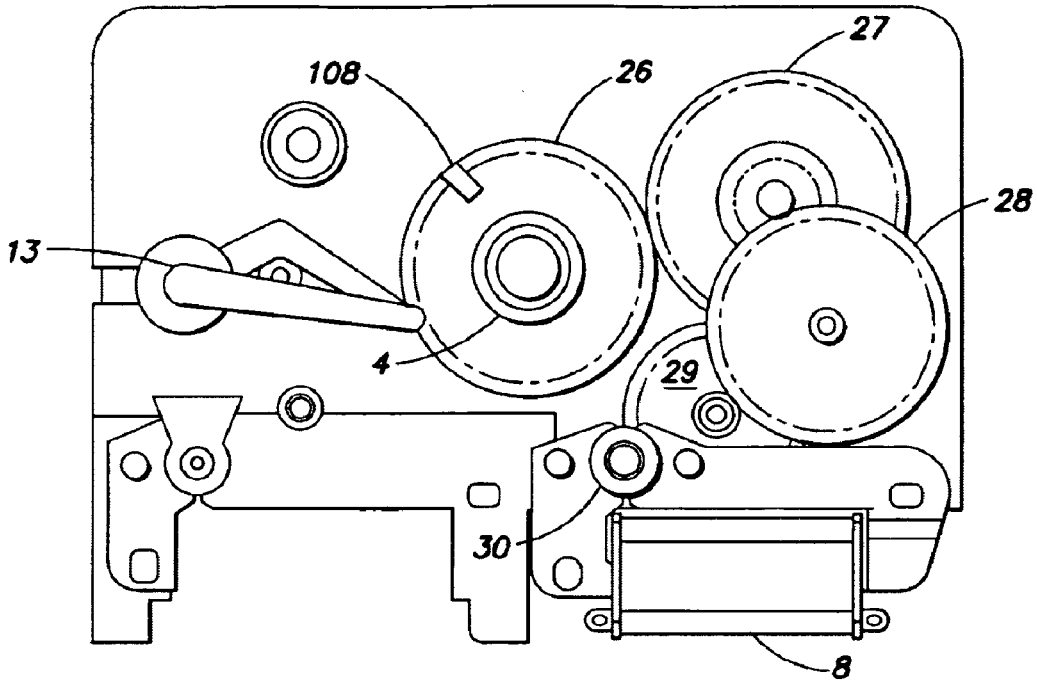
FIG. 13 is a plan view of an alarm hand embodiment.
Figure 14:
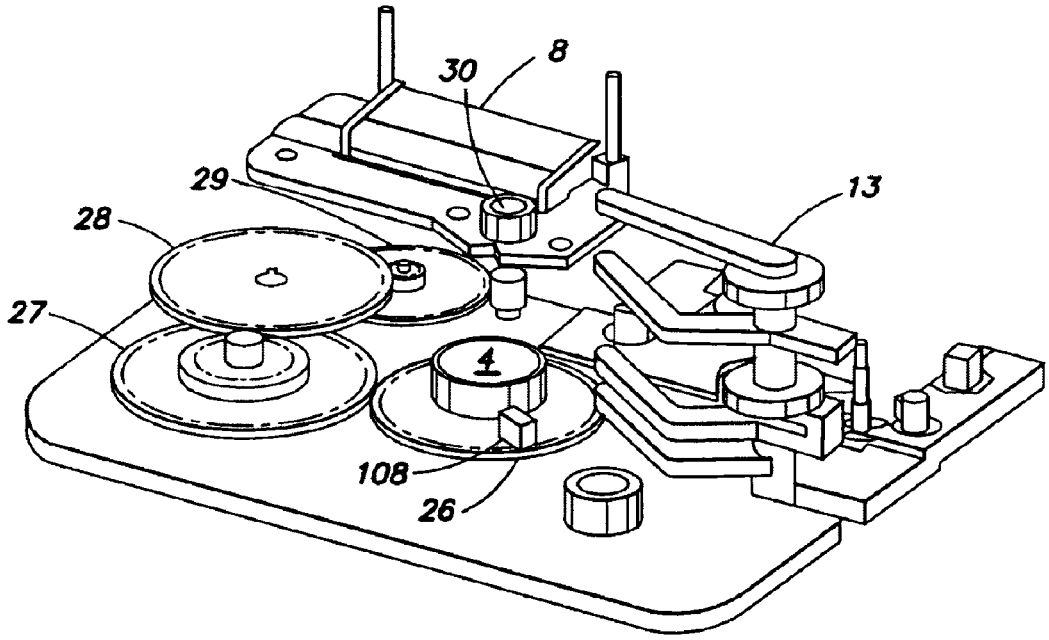
FIG. 14 is an isometric view of an alarm hand embodiment.

FIG. 13 is plan view illustration of an alarm hand embodiment, while FIG. 14 is an isometric view of the same embodiment. The alarm hand shaft 4 is driven by a center wheel-shaft gear 26, a center wheel-idler 27, an intermediate wheel 28, a transmission wheel 29 and a rotor 30 to make the desired positioning rotation. The alarm hand shaft 4 rotates until protrusion 108 strikes the reset claw 13 at the datum position.

Notably, the timepiece of the present invention is capable of automatically setting the second hand shaft 1, the minute hand shaft 2, the hour hand shaft 3 and the alarm hand shaft 4, respectively, to an absolute position (e.g., 12:00 o'clock), ready to receive the radio time signal. The rotation of the second hand shaft 1, the minute hand shaft 2, the hour hand shaft 3 and the alarm hand shaft are preferably driven by independent stepper motors 5–8, respectively, which are controlled by digital pulse signals generated by the microcontroller 9.

Inputs for manually adjusting the time and calendar are input via the rubber keypad 10. When the time is manually adjusted via the keypad or after successful reception of a radio time signal, the microcontroller 9 generates pulse signals to the stepper motors 5, 6, 7 and 8 to drive the second hand shaft 1, the minute hand shaft 2, the hour hand shaft 3 and the alarm hand shaft (4), respectively, to the corresponding position. When the system is reset via the reset knob 12, the reset claw 13 is activated and the microcontroller 9 causes the hand shafts to be rotated to the datum position. The LCD display 11 is also updated. To rotate the hand shafts to the datum position, the microcontroller 9 generates pulse signals for one and a quarter rotation to the stepper motors 5–8 to rotate the hand shafts. However, as set forth above, each of the hands will rotate less than one rotation since the reset claw will prevent rotation beyond the datum position.

The radio controllable clock may be remotely controlled, preferably by radio signals, In addition, the microcontroller 9 may act as a master adapted to control the analog clock as a slave without receiving radio time signals. Further, the radio controllable clock may be adapted to be incorporated into computers (e.g., personal computers), to ensure that the computer has the exact time.

Although the present invention has been shown and described with respect to several preferred embodiments thereof, various changes, omissions and additions to the form and detail thereof, may be made therein, without departing from the spirit and scope of the invention.

What is claimed is:

1. A radio controllable clock, comprising:

an analog display having a plurality of clock hands each fastened to a uniquely associated one of a plurality of clock hand shafts that each rotate about a common axis;

a plurality of rotary gears each uniquely associated with one of said clock hand shafts, for rotating said clock hand shafts, each rotary gear having a face perpendicular to the common axis, wherein each of said rotary gears includes a protrusion extending substantially perpendicular from said face;

a microcontroller that provides a plurality of drive command signals;

means responsive to said drive command signals, for driving said rotary gears; and a reset claw operably positioned to engage at least one of said protrusions to stop the rotation of said clock hand shaft associated with said protrusion to position said clock hand associated with said protrusion at a datum position.

2. The radio controllable clock of claim 1, wherein said means for driving said rotary gears comprises a stepper motor.

3. The radio controllable clock of claim 2, comprising an alarm hand shaft, an alarm hand stepper motor and an alarm hand rotary wheel, wherein said alarm hand stepper motor drives said alarm hand rotary wheel to rotate said alarm hand shaft.

4. The radio controllable clock of claim 1 wherein said reset claw comprises a plurality of arms, wherein each of said arms engages an associated one of said protrusions to stop the rotation of said rotary gear associated therewith to position said clock hands at said datum position.

5. The radio controllable clock of claim 4, wherein said plurality of clock hands comprises a second hand, a minute hand and an hour hand and said plurality of arms comprises:

a first arm that engages a first protrusion on a first of said plurality of rotary gears that is associated with said second hand;

a second arm that engages a second protrusion on a second of said plurality of rotary gears that is associated with said minute hand; and a third arm that engages a third protrusion on a third of said plurality of rotary gears that is associated with said hour hand.

6. The radio controllable clock of claim 5, wherein said microcontroller generates pulses to rotate said minute hand at least one and a quarter rotation, wherein said minute hand is driven by said stepper motor through a plurality of cooperating rotary gears comprising (i) said second of said plurality of rotary gears, (ii) a minute hand centre wheel-idler, (iii) a minute hand intermediate wheel, (iv) a minute hand transmission wheel, and (v) a rotor.

7. The radio controllable clock of claim 4, wherein each of said arms is movable.

8. The radio controllable clock of claim 7, wherein each of said arms pivots about a common axis.

9. The radio controllable clock of claim 4, wherein each of said arms is configured and arranged to be positioned in a first position and a second position, wherein while in said first position said arm is in the path of rotation of said protrusion, and in said second position said arm is outside the path of rotation of said protrusion.

10. The radio controllable clock of claim 5, wherein said microcontroller generates pulses to rotate said second hand at least one and a quarter rotation, wherein said second hand is driven through a plurality of cooperating rotary gears comprising (i) said first of said plurality of rotary gears, (ii) a second hand centre wheel-idler, (iii) a second hand intermediate wheel, (iv) a second hand transmission wheel, and (v) a rotor.

11. The radio controllable clock of claim 5, wherein said microcontroller generates pulses to rotate said hour hand at least one and a quarter rotation, wherein said hour hand is driven through a plurality of cooperating rotary gears comprising (i) said third of said plurality of rotary gears, (ii) an hour hand centre wheel-idler, (iii) an hour hand intermediate wheel, (iv) an hour hand transmission wheel, and (v) a rotor.

12. The radio controllable clock of claim 1, wherein said microcontroller generates pulses sufficient to drive each of said plurality of clock hand shafts to rotate said each of said plurality of clock hands associated therewith at least one complete revolution.

13. The radio controllable clock of claim 1, comprising a flat panel display for displaying time and date information.

14. The radio controllable clock of claim 1, comprising a reset knob for manually commanding said microcontroller to issue said plurality of drive command signals.

15. A radio controllable clock, comprising:

a plurality of clock hands each fastened to a uniquely associated one of a plurality of clock hand shafts;

a plurality of rotary gears each uniquely associated with one of said clock hand shafts, for rotating said clock hand shafts, each rotary gear having a face, wherein each of said rotary gears includes a protrusion extending substantially perpendicular to said face;

a controller that provides a plurality of drive command signals;

motors responsive to said drive command signals, for driving said rotary gears to rotate a selected one of said clock hands; and means, operably positionable to engage said protrusion at a selected rotary position of said rotary gear, for stopping clockwise or counter clockwise rotation of said associated rotary gear to position said associated clock hand at a datum position.

16. The radio controllable clock of claim 15, wherein said motors comprise a stepper motor.

17. The radio controllable clock of claim 15, wherein said motors comprise torque motors.

18. The radio controllable clock of claim 15, wherein said means for stopping comprises a reset claw including a plurality of arms, wherein each of said arms engages a uniquely associated one of said protrusions to stop the rotation of said associated rotary gear and thus position said associated clock hand at the datum position wherein each of said arms is configured and arranged to be positioned in a first position and a second position, wherein while in said first position said arm is in the path of rotation of said protrusion, and in said second position said arm is outside the path of rotation of said protrusion.

19. A radio controllable clock, comprising:

a plurality of clock hands each fastened to a uniquely associated one of a plurality of clock hand shafts;

a plurality of rotary gears each uniquely associated with one of said clock hand shafts, for rotating said clock hand shafts, each rotary gear having a face, wherein each of said rotary gears includes a protrusion extending substantially perpendicular to said face;

a controller that provides a plurality of drive command signals;

a least one motor responsive to said drive command signals, for driving said rotary gears to rotate a selected one of said clock hands; and a pivotal arm, operably positionable to engage said protrusion at a selected rotary position of said rotary gear, for stopping clockwise or counter clockwise rotation of said associated rotary gear to position said associated clock hand at a datum position.

* * * * *

UNITED STATES PATENT AND TRADEMARK OFFICE

CERTIFICATE OF CORRECTION

PATENT NO. : 6,965,543 B1
DATED : November 15, 2005
INVENTOR(S) : Shum et al.

It is certified that error appears in the above-identified patent and that said Letters Patent is hereby corrected as shown below:

Column 1,
Line 26, delete “reliablely” and insert -- reliably --.

Column 2,
Line 11, after “panel” insert -- LCD --.

Column 3,
Lines 4 and 6, delete “,” and insert -- ; --.

Column 4,
Line 50, after “alarm shaft hand” insert -- 4 --.

Column 5,
Line 5, after “signals”, delete “,” and insert -- . --.

Signed and Sealed this

Fourteenth Day of March, 2006

JON W. DUDAS
*Director of the United States Patent and Trademark Office*